US009677724B2

(12) United States Patent
McClean

(10) Patent No.: US 9,677,724 B2
(45) Date of Patent: Jun. 13, 2017

(54) PORTABLE COLLAPSIBLE BIOMASS STOVE AND LANTERN

(71) Applicant: Adventures in Sustainability, LLC, Cottage Grove, OR (US)

(72) Inventor: Andrew Lawrence McClean, Cottage Grove, OR (US)

(73) Assignee: Adventures in Sustainability, LLC, Cottage Grove, OR (US)

( * ) Notice: Subject to any disclaimer, the term of this patent is extended or adjusted under 35 U.S.C. 154(b) by 261 days.

(21) Appl. No.: 14/631,631

(22) Filed: Feb. 25, 2015

(65) Prior Publication Data

US 2016/0245529 A1 Aug. 25, 2016

Related U.S. Application Data

(60) Provisional application No. 62/041,455, filed on Aug. 25, 2014.

(51) Int. Cl.

| | |
|---|---|
| ***F24B 1/19*** | (2006.01) |
| ***F21L 19/00*** | (2006.01) |
| ***F21L 26/00*** | (2006.01) |
| ***F24B 1/195*** | (2006.01) |
| ***F24B 1/02*** | (2006.01) |
| *F21W 131/10* | (2006.01) |

(52) U.S. Cl.

CPC ..... *F21L 26/00* (2013.01); *F24B 1/022* (2013.01); *F21L 19/00* (2013.01); *F21W 2131/10* (2013.01)

(58) Field of Classification Search

CPC ..... F24B 1/19; F24B 1/1957; F24B 1/022; F23D 14/04; F21L 26/00; F21L 19/00

USPC ..... 126/25 A, 267, 9 R, 4, 25 R

See application file for complete search history.

(56) References Cited

U.S. PATENT DOCUMENTS

| | | | | | |
|---|---|---|---|---|---|
| 1,039,123 | A | * | 9/1912 | Hamm | F21L 19/00 362/182 |
| 1,514,595 | A | | 11/1924 | Martin | |
| 2,019,604 | A | | 11/1935 | Grieve | |
| 2,169,735 | A | | 8/1939 | Keller | |
| 2,638,085 | A | | 5/1953 | Guedon | |
| 3,133,536 | A | | 5/1964 | Knapp | |
| 3,225,756 | A | | 12/1965 | Bencoe | |
| D213,652 | S | * | 3/1969 | Salvatore | D7/337 |
| 3,498,240 | A | | 3/1970 | Trott | |
| 3,773,458 | A | | 11/1973 | Spotts | |

(Continued)

*Primary Examiner* — Avinash Savani
*Assistant Examiner* — Rabeeul Zuberi
(74) *Attorney, Agent, or Firm* — Meng Ouyang

(57) ABSTRACT

A portable and collapsible stove and lantern allowing clean combustion of biomass fuels found in the natural environment comprises a top member, a transparent member, a support member having an orifice and a plurality of windows, a chamber having a plurality of top and bottom openings and a mesh to support biomass fuels, and a main body having an insulation member, a reflecting member and a plurality of middle openings. When used, the transparent member is disposed within the support member that is disposed on top of the chamber which is then disposed within the main body, and the top member is disposed on top of the support member. Air drawn into the main body by the plurality of middle openings is further drawn into the chamber by the pluralities of top and bottom openings, mixed with fuels for combustion, producing flame into the support member through the orifice.

11 Claims, 5 Drawing Sheets

(56) References Cited

U.S. PATENT DOCUMENTS

| | | | | | |
|---|---|---|---|---|---|
| 3,941,554 | A | | 3/1976 | Curtis | |
| 4,338,075 | A | | 7/1982 | Bemm | |
| 4,545,360 | A | | 10/1985 | Smith | |
| 4,572,157 | A | * | 2/1986 | Napier | F24C 1/16 126/258 |
| 4,730,597 | A | | 3/1988 | Hottenroth | |
| 5,678,494 | A | | 10/1997 | Ulrigh | |
| 5,713,343 | A | | 2/1998 | Taylor | |
| 5,797,386 | A | * | 8/1998 | Orr | A47J 37/0704 126/25 A |
| 5,873,356 | A | | 2/1999 | Vossler et al. | |
| 5,941,234 | A | | 8/1999 | Norburn et al. | |
| 6,030,093 | A | * | 2/2000 | Draper | F21L 19/00 362/161 |
| 6,086,216 | A | | 7/2000 | Goldfarb | |
| 6,223,737 | B1 | | 5/2001 | Buckner | |
| 6,688,877 | B1 | | 2/2004 | Draper | |
| 6,846,091 | B2 | | 1/2005 | Long | |
| 7,347,582 | B1 | * | 3/2008 | Kung | F21L 4/00 362/177 |
| 7,823,578 | B2 | | 11/2010 | Ruppel et al. | |
| 8,297,271 | B2 | | 10/2012 | Cedar et al. | |
| 2003/0140827 | A1 | | 7/2003 | Wilfer | |
| 2007/0215143 | A1 | | 9/2007 | McCormick et al. | |
| 2012/0023819 | A1 | | 2/2012 | Marano | |
| 2012/0060819 | A1 | * | 3/2012 | Hunt | A47J 36/2477 126/1 R |
| 2014/0202363 | A1 | | 7/2014 | Hiraguri | |

* cited by examiner

PORTABLE COLLAPSIBLE BIOMASS STOVE AND LANTERN

CROSS-REFERENCE TO RELATED APPLICATIONS

This application claims the benefit under 35 U.S.C. §119 (e) of U.S. Provisional Application Ser. No. 62/041,455 filed Aug. 25, 2014.

BACKGROUND

1. Field of the Invention

This invention is in the technical field of stoves. More specifically, this invention is directed to a portable stove and lantern that is light-weight and collapsible, and burns biomass fuels available in a natural environment, which is especially convenient for outdoor cooking and lighting when travelling, camping and backpacking.

2. Background of Related Art

When travelling, camping, or backpacking, fuels are needed in order to cook food or light a lantern. However, storing and carrying around liquid petrochemical or combustible gas fuels while on the go are both inconvenient and unsafe. Additionally, it is known that these types of fuels emit harmful pollutants into the air. Containers for these types of fuels that are single use cause additional environmental pollution. Unfortunately, existing portable stoves require liquid petrochemical or combustible gas as fuel.

What is needed is a portable stove that not only utilizes biomass fuels found in the natural environment, solving the problem of fuel carrying and storage, but also allows clean combustion to reduce air pollution. The ideal portable stove also needs to be light-weight and collapsible for easy carrying and space saving.

SUMMARY

The invention is directed to a portable and collapsible stove and lantern that meets the needs to utilize biomass fuels found in the natural environment, avoiding the inconvenience and safety concern of fuel carrying and storage, and to allow clean combustion of biomass fuels, reducing air pollution.

The stove and lantern comprises a top member, a transparent member, a support member, a chamber, and a main body.

The top member has a substantially planar sheet with a top surface and a bottom surface and a rim, and a curved wall connected to the bottom surface of the sheet along the rim. The sheet has an opening in its center and a plurality of protrusions on the top surface of the sheet.

The transparent member has a closed transparent curved wall connecting two open ends.

The support member has a top open end and a bottom end connected by a closed curved wall. The wall of the support member has a plurality of windows. The bottom end of the support member has an orifice in its center, a rim, and a sloped surface extending from the rim towards the top end of the support member and ending at the orifice. The top end of the support member has the same shape and dimension as the sheet such that the top member can sit tightly on the top end of the support member with the wall of the top member inserted into the support member. The top and bottom ends of the support member have dimensions larger than the dimensions of the two ends of the transparent member such that the transparent member can be disposed within the support member with the walls of the transparent member and the support member being substantially parallel to each other.

The chamber has a top open end and a bottom open end connected by a closed curved wall, and a mesh connected to the wall of the chamber from inside near the bottom end of the chamber and being parallel to the top and bottom ends of the chamber. The wall of the chamber has a plurality of top openings near the top end of the chamber and a plurality of bottom openings near the bottom end of the chamber. The plurality of top openings and the plurality of bottom openings each form a line parallel to the rims of the top and bottom ends of the chamber. The plurality of bottom openings are closer than the mesh to the bottom end of the chamber. The top and bottom ends of the chamber have dimensions smaller than the dimensions of the ends of the transparent member such that the chamber can be disposed within the transparent member with the mesh down.

The main body has a top open end and a substantially planar bottom end connected by a closed curved wall, a substantially planar insulation member, and a substantially planar reflecting member having a top surface with a plurality of reflectors and a bottom surface connected to the insulation member which then is connected to the bottom end of the main body. The wall of the main body has a plurality of middle openings forming a line parallel to the rims of the top and bottom ends of the main body. The plurality of middle openings are at a lower height than the plurality of top openings and a higher height than the plurality of bottom openings when the chamber is disposed within the main body with the bottom end of the chamber down. The top and bottom ends of the main body have dimensions larger than the dimensions of the top and bottom ends of the support member such that the support member can be disposed within the main body with the bottom end of the support member down.

In one embodiment, the sheet is a circle.

In one embodiment, the stove and lantern includes 15 middle openings, 21 top openings and 21 bottom openings.

In one embodiment, the plurality of middle openings, the plurality of top openings, and the plurality of bottom openings are all circles.

In one embodiment where the plurality of middle openings, the plurality of top openings, and the plurality of bottom openings are all circles, the plurality of middle openings have a diameter of 1.3 cm, the plurality of top openings and the plurality of bottom openings have a diameter of 1 cm, the support member has a height of 14 cm, and the orifice and the bottom end of the support member have a shortest distance of 2.2 cm.

In one embodiment, the plurality of middle openings are positioned with equal distance to the top and bottom ends of the main body.

In one embodiment, the stove and lantern includes three protrusions.

In one embodiment, the stove and lantern includes four protrusions.

In one embodiment, the stove and lantern includes four reflectors.

In one embodiment, the transparent member is made of glass.

It is understood that drawings are for illustration only and are not limiting.

DETAILED DESCRIPTION

Figure 1A:
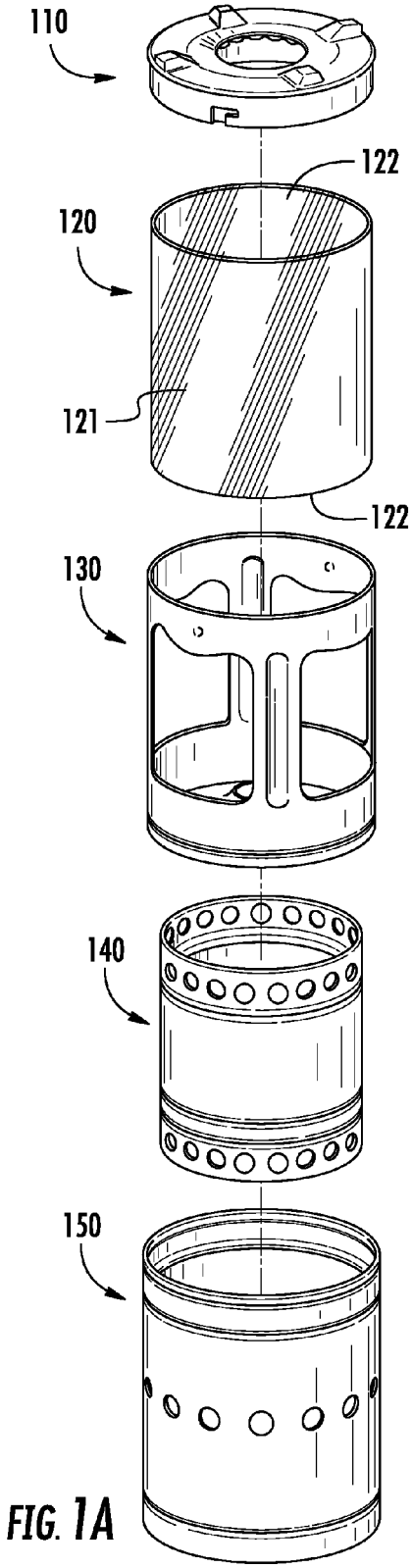
FIG. 1A is an exploded perspective view of one embodiment of the invention showing the stove set up in the way to be used.
Figure 1B:
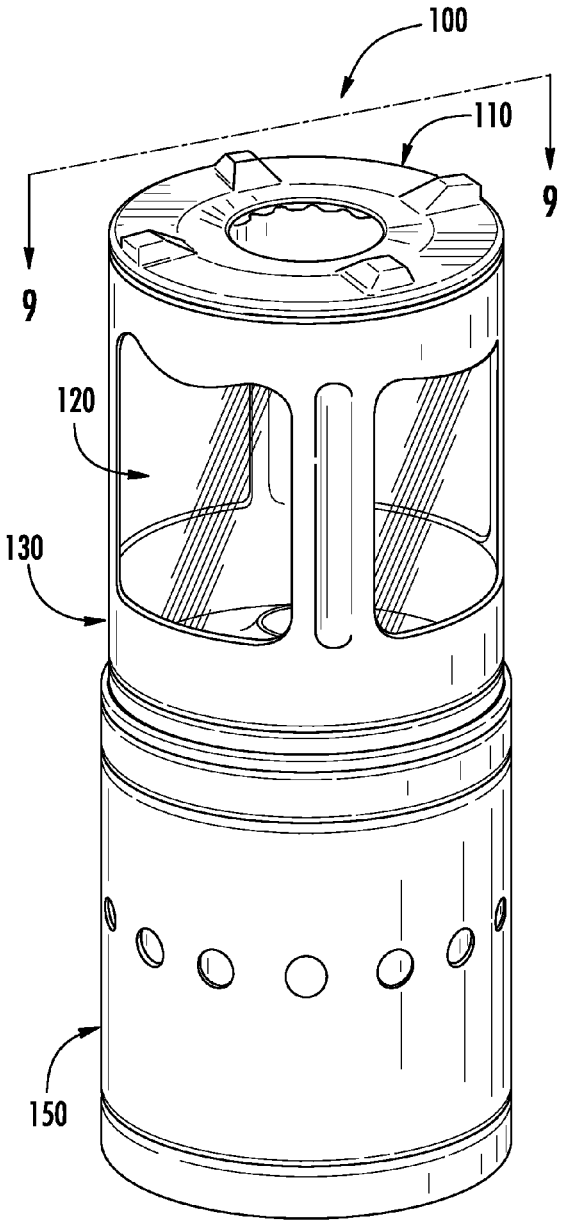
FIG. 1B is a perspective view of the same embodiment of the invention as shown in FIG. 1A.
Figure 2A:
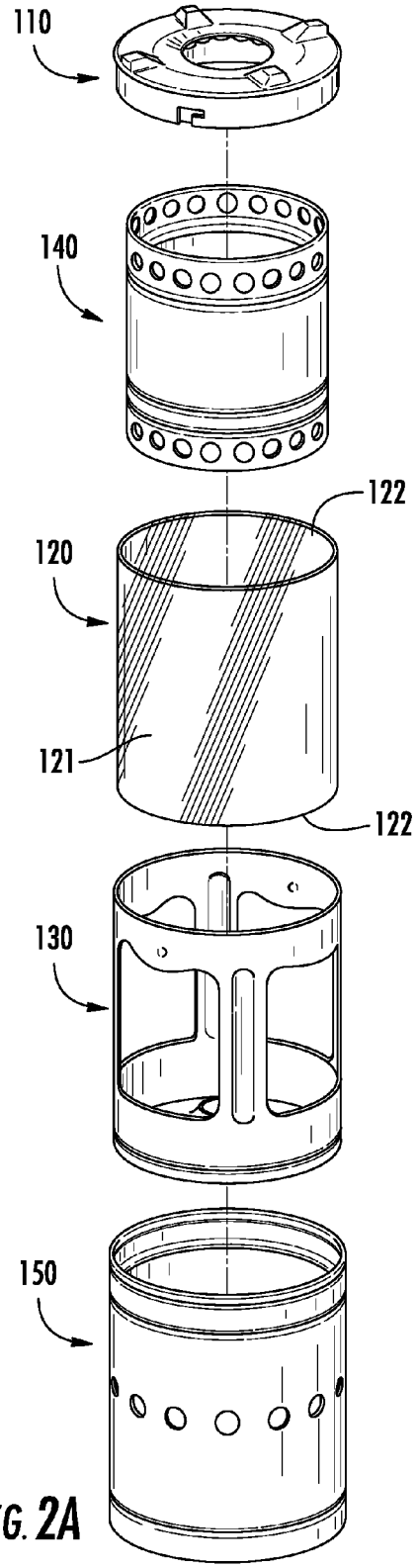
FIG. 2A is an exploded perspective view of one embodiment of the invention, showing the stove and lantern about to be collapsed for carrying and storage.
Figure 2B:
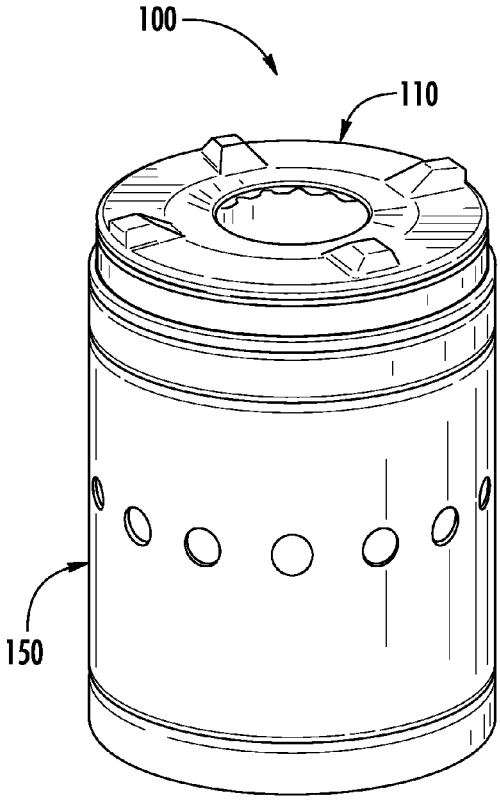
FIG. 2B is a perspective view of the same embodiment of the invention as shown in FIG. 2A, showing the stove and lantern collapsed and ready for carrying and storage.

Referring to FIGS. 1A and 2A, there is shown generally, one embodiment of a portable collapsible stove and lantern 100 of the invention. Stove and lantern 100 comprises a top member 110, a transparent member 120, a support member 130, a chamber 140, and a main body 150. When stove and lantern 100 is set up to be used as shown in FIG. 1B, as shown in the order presented in FIG. 1A, transparent member 120 is disposed within support member 130 which is disposed on top of chamber 140 which is further disposed within main body 150, and top member 110 is disposed on top of support member 130, covering transparent member 120 disposed therein. When stove and lantern 100 is collapsed for carrying and storage as shown in FIG. 2B, as shown in the order presented in FIG. 2A, chamber 140 is disposed within transparent member 120 which is disposed within support member 130 which is further disposed within main body 150, and top member 110 is disposed on top of support member, covering chamber 140 and transparent member 120 disposed therein.

Figure 3:
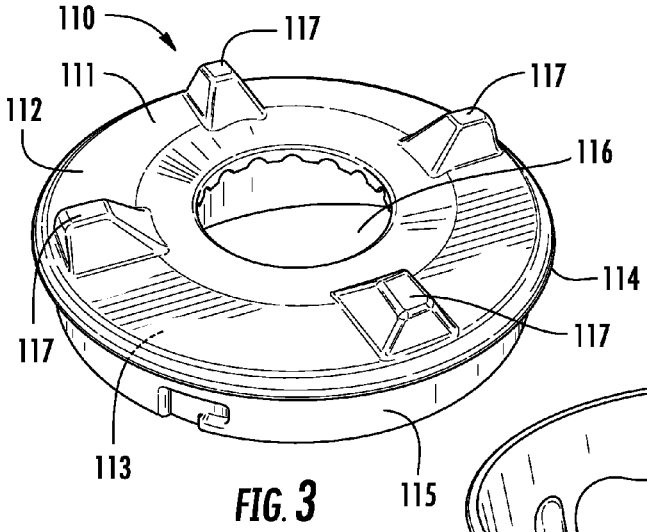
FIG. 3 is a perspective view of the top member in the embodiment shown in FIG. 1A.

Referring to FIG. 3, top member 110 has a substantially planar sheet 111 with a top surface 112 and a bottom surface 113 and a rim 114, and a curved wall 115 connected to bottom surface 113 along rim 114. Sheet 111 has an opening 116 in its center and a plurality of protrusions 117 on top surface 112.

As shown in FIGS. 1A and 1B, transparent member 120 has a closed transparent curved wall 121 connecting two open ends 122.

Figure 4:
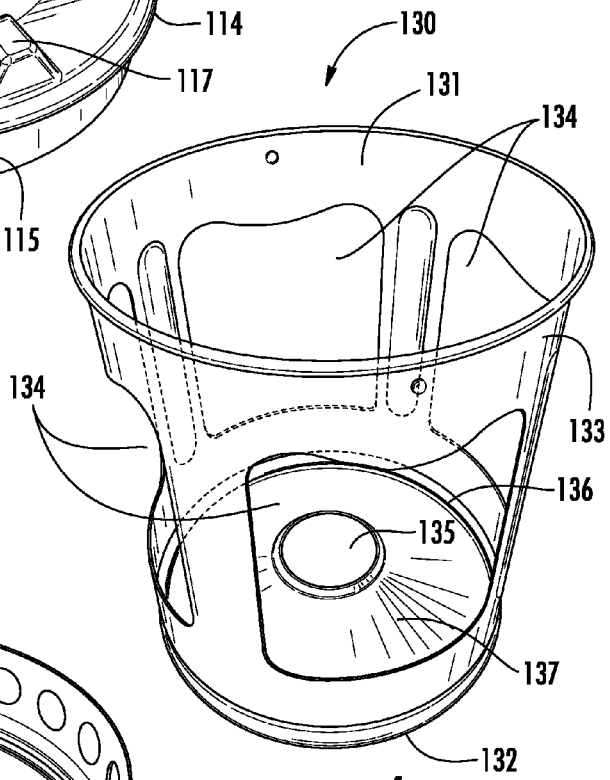
FIG. 4 is a perspective view of the support member in the embodiment shown in FIG. 1A.

Referring to FIG. 4, support member 130 has a top open end 131, a bottom end 132, and a closed curved wall 133 connecting top and bottom ends 131 and 132. Wall 133 has a plurality of windows 134. Bottom end 132 has an orifice 135 in its center, a rim 136, and a sloped surface 137 extending from rim 136 towards top end 131 and ending at orifice 135. Top end 131 has the same shape and dimension as sheet 111 such that top member 110 can sit tightly on top end 131 with wall 115 of top member 110 inserted into support member 130. Top and bottom ends 131 and 132 of support member 130 have dimensions larger than the dimensions of the two ends 122 of transparent member 120 such that transparent member 120 can be disposed within support member 130 with wall 121 of transparent member 120 and wall 133 of support member 130 being substantially parallel to each other.

Figure 5:
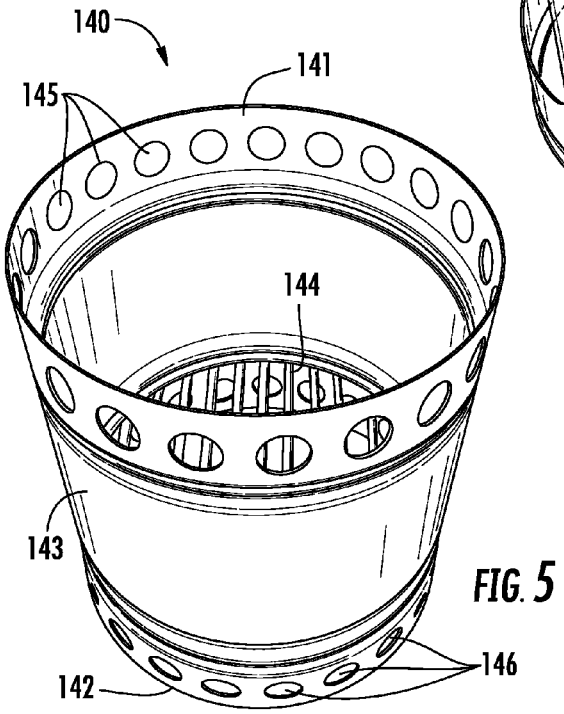
FIG. 5 is a perspective view of the chamber in the embodiment shown in FIG. 1A.

Referring to FIG. 5, chamber 140 has a top open end 141 and a bottom open end 142 connected by a closed curved wall 143, and a mesh 144 connected to wall 143 from inside near bottom end 142 and being parallel to top and bottom ends 141 and 142. Wall 143 has a plurality of top openings 145 near top end 141 and a plurality of bottom openings 146 near bottom end 142. Plurality of top openings 145 and plurality of bottom openings 146 each form a line parallel to the rims of top and bottom ends 141 and 142. Plurality of bottom openings 146 are closer in distance than mesh 144 to bottom end 142. Top and bottom ends 141 and 142 have dimensions smaller than the dimensions of two ends 122 of transparent member 120 such that chamber 140 can be disposed within transparent member 120 with mesh 144 down.

Figure 6:
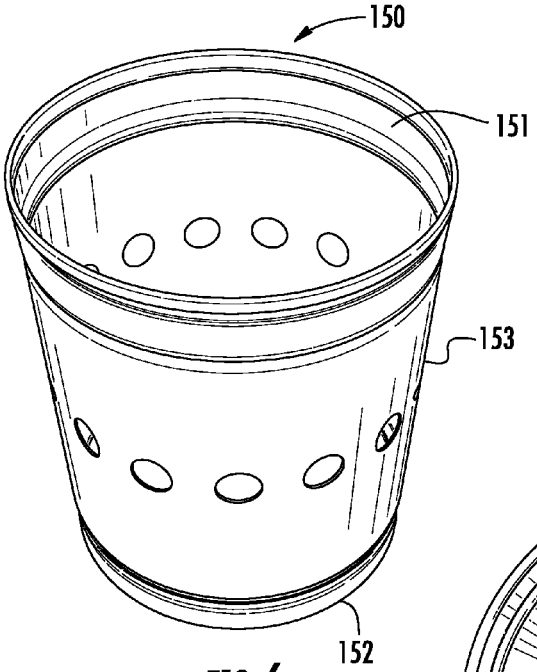
FIG. 6 is a perspective view of the main body in the embodiment shown in FIG. 1A.
Figure 7:
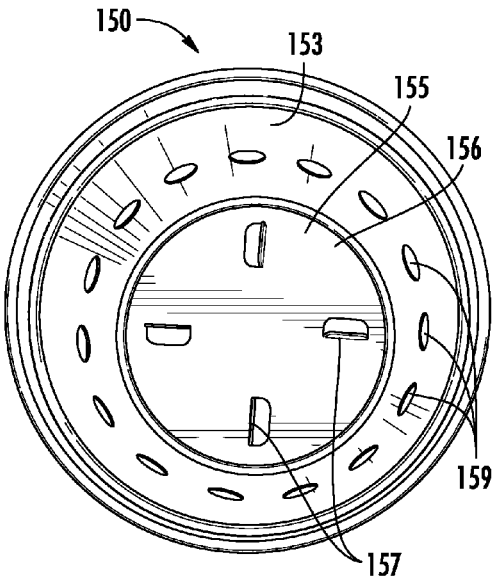
FIG. 7 is a top view of the main body as shown in FIG. 6.
Figure 8:
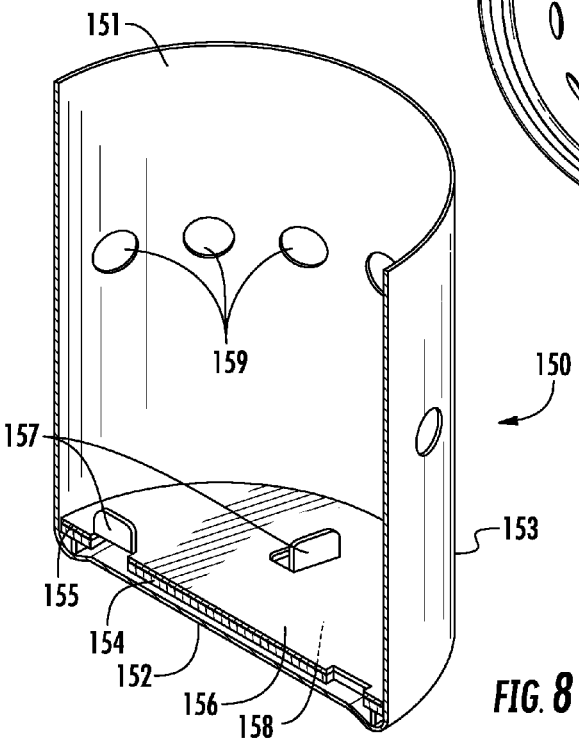
FIG. 8 is a cross sectional view of the main body as shown in FIG. 6.

Referring to FIGS. 6 and 8, main body 150 has a top open end 151 and a substantially planar bottom end 152 connected by a closed curved wall 153, a substantially planar insulation member 154 (FIG. 8), and a substantially planar reflecting member 155 having a top surface 156 with a plurality of reflectors 157 (FIGS. 7-8) and a bottom surface 158 connected to insulation member 154 which then connected to bottom end 152 (FIG. 8). Wall 153 has a plurality of middle openings 159 forming a line parallel to the rims of top and bottom ends 151 and 152. When chamber 140 is disposed within main body 150 with bottom end 142 down, plurality of middle openings 159 are at a lower height than plurality of top openings 145 and a higher height than plurality of bottom openings 146. Top and bottom ends 151 and 152 have dimensions larger than the dimensions of top and bottom ends 131 and 132 such that support member 130 can be disposed within main body 150 with bottom end 132 down.

Figure 9:
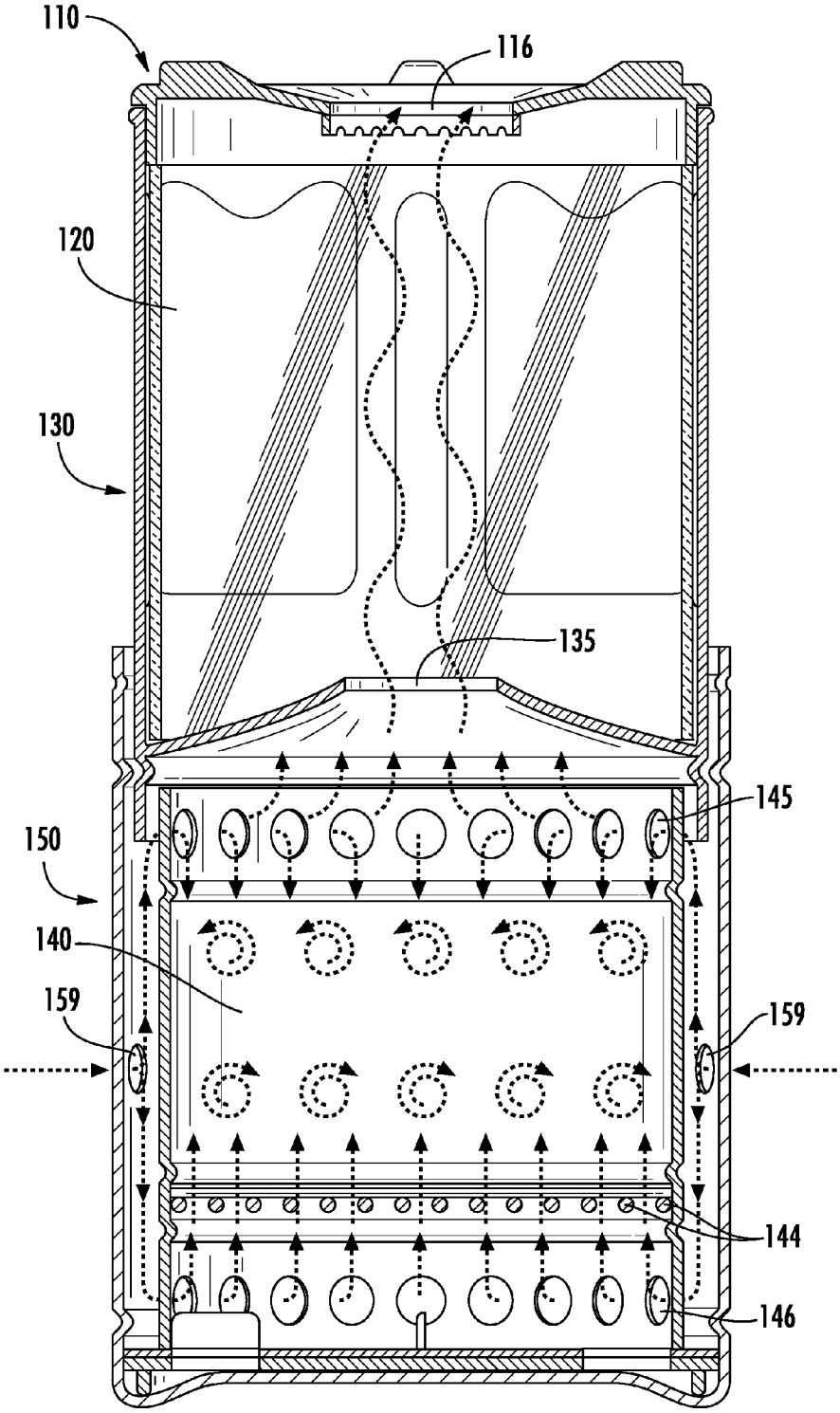
FIG. 9 is a cross sectional schematic view of the embodiment of the stove and lantern shown in FIG. 1B, showing exemplary air-to-air heat exchanging flow paths.

When stove and lantern 100 is set up as shown in FIG. 1B for cooking and lighting, FIG. 9 shows the exemplary air-to-air heat exchanging flow paths. Air is first drawn into main body 150 through plurality of middle openings 159 and is further drawn into chamber 140 by pluralities of top and bottom openings 145 and 146. Fuels placed on mesh 144 are first mixed with air drawn in by plurality of bottom openings 146 as primary air for combustion, and is further mixed with air drawn in by plurality of top openings 145 as secondary air, resulting in clean combustion, producing flame and heat going up through orifice 135 into transparent member 120 and further up through opening 116 of top member 110.

Turning now to an example of setting up and using stove and lantern 100 as illustrated in FIGS. 1A-1B. A user first disposes chamber 140 within main body 150 to set up the fuel burning portion. The user also disposes transparent member 120 within support member 130 and disposes top member 110 on top of support member 130 to set up the lantern and cooktop portion. The user will then gather biomass fuels found in a natural environment (or wood stove pellet if the user chooses), such as sticks and tree branches, prepare the biomass fuels (e.g., cutting) so that the size of the fuels fits within chamber 140. The user then places the fuels on mesh 144 of chamber 140 such that the height of the fuels reaches the line on wall 143 immediately below top openings 145. For easy ignition, the user should place flashy fuels on the top, or alternatively, place fire starter gel on top of the fuels, and then the user can ignite the fuels using a lighter. After the fuels are ignited for a few minutes with a good flame, the user then disposes the lantern and cooktop portion on top of the fuel burning portion, resulting in the setup of stove and lantern 100 as shown in FIG. 1B. The user can place a cooking pot or any container for stovetop cooking on top of top member 110. The combustion of fuels in chamber 140 produces flame which goes through orifice 135 and up through opening 116 of top member 110 to provide heat for cooking as well as light through plurality of windows 134.

When the user is ready to carry or store stove and lantern 100 after the fire is put out, it can be collapsed following FIGS. 2A-2B. After separating the lantern and cooktop portion from the fuel burning portion, the user removes top member 110 from the lantern and cooktop portion, removes chamber 140 from main body 150, empties chamber 140, and then disposes chamber 140 within transparent member 120 that is still disposed within transparent member 120, which the user now disposes within main body 150. Finally the user disposes top member 110 back on top of support member 130, resulting the collapsed stove and lantern 100 shown in FIG. 2B.

For safety and ease of use, a multipurpose handle may be used when disposing or removing any part of stove and lantern 100 when it is hot. When carrying or storing stove and lantern 100, the multipurpose handle can be placed through opening 116 within chamber 140, and stove and lantern 100 can be placed within a tea pot having a handle for easy carrying.

It is noted that, as used in this specification and the appended claims, the singular forms "a," "an," and "the," include plural referents unless expressly and unequivocally limited to one referent. As used herein, the term "include" and its grammatical variants are intended to be non-limiting, such that recitation of items in a list is not to the exclusion of other like items that can be substituted or other items that can be added to the listed items.

Upon studying the disclosure, it will be apparent to those skilled in the art that various modifications and variations can be made in the stove and lantern 100 and methods of various embodiments of the invention. Other embodiments will be apparent to those skilled in the art from consideration of the specification and practice of the embodiments disclosed herein. It is intended that the specification be considered as examples only. The various embodiments are not necessarily mutually exclusive, as some embodiments can be combined with one or more other embodiments to form new embodiments.

What is claimed is:

1. A stove and lantern comprising:

a top member having a substantially planar sheet with a top surface and a bottom surface and a rim, and a curved wall connected to the bottom surface along the rim, the sheet having an opening in its center and a plurality of protrusions on the top surface of the sheet;

a transparent member having a closed transparent curved wall connecting two open ends;

a support member having a top open end and a bottom end connected by a closed curved wall, the wall having a plurality of windows, the bottom end of the support member having an orifice in its center, a rim, and a sloped surface extending from the rim upward towards the top end of the support member and ending at the orifice, the top end of the support member having the same shape and dimension as the sheet such that the top member can sit tightly on the top end of the support member with the wall of the top member inserted into the support member, the top and bottom ends of the support member having dimensions larger than the dimensions of the two ends of the transparent member such that the transparent member can be disposed within the support member with the walls of the transparent member and the support member being substantially parallel to each other;

a chamber having a top open end and a bottom open end connected by a closed curved wall, and a mesh connected to the wall from side near the bottom end of the chamber and being parallel to the top and bottom ends of the chamber, the wall of the chamber having a plurality of top openings near the top end of the chamber and a plurality of bottom openings near the bottom end of the chamber, the plurality of top openings and the plurality of bottom openings each forming a line parallel to the rims of the top and bottom ends of the chamber, the plurality of bottom openings being closer in distance than the mesh to the bottom end of the chamber, the top and bottom ends of the chamber having dimensions smaller than the dimensions of the ends of the transparent member such that the chamber can be disposed within the transparent member with the mesh down; and a main body having a top open end and a substantially planar bottom end connected by a closed curved wall, a substantially planar insulation member that is entirely solid, and a substantially planar reflecting member having a top surface with a plurality of reflectors and a bottom surface connected to the insulation member which then connected to the bottom end of the main body, the wall of the main body having a plurality of middle openings forming a line parallel to the rims of the top and bottom ends of the main body, the plurality of middle openings being at a lower height than the plurality of top openings and a higher height than the plurality of bottom openings when the chamber is disposed within the main body with the bottom end of the chamber down, the top and bottom ends of the main body having dimensions larger than the dimensions of the top and bottom ends of the support member such that the support member can be disposed within the main body with the bottom end of the support member down.

2. A stove according to claim 1, wherein the sheet is a circle.

3. A stove according to claim 1, further comprising exactly 15 middle openings, 21top openings and 21 bottom openings.

4. A stove according to claim 1, wherein the plurality of middle openings, the plurality of top openings, and the plurality of bottom openings are all circles.

5. A stove according to claim 4, the plurality of middle openings have a diameter of 1.3 cm, the plurality of top openings and the plurality of bottom openings have a diameter of a 1 cm, the support member has a height of 14 cm, and the orifice and the bottom end of the support member have a shortest distance of 2.2 cm.

6. A stove according to claim 1, wherein the plurality of middle openings are positioned with equal distance to the top and bottom ends of the main body.

7. A stove according to claim 1, further comprising exactly three protrusions.

8. A stove according to claim 1, further comprising exactly four protrusions.

9. A stove according to claim 1, further comprising exactly three windows.

10. A stove according to claim 1, further comprising exactly four reflectors.

11. A stove according to claim 1, wherein the transparent member is made of glass.

* * * * *